US005429512A

United States Patent [19]

Sawamura

[11] Patent Number: 5,429,512

[45] Date of Patent: Jul. 4, 1995

[54] TERMINAL ARRANGEMENT

[75] Inventor: Naohito Sawamura, Yokkaichi, Japan

[73] Assignee: Sumitomo Wiring Systems, Ltd., Yokkaichi, Japan

[21] Appl. No.: 191,486

[22] Filed: Feb. 4, 1994

[30] Foreign Application Priority Data

Mar. 3, 1993 [JP] Japan ..... 5-008508 U

[51] Int. Cl.[6] ..... H01R 4/34

[52] U.S. Cl. ..... 439/97; 439/877; 439/883

[58] Field of Search ..... 439/801, 97, 877, 792, 439/883; 403/408.1

[56] References Cited

U.S. PATENT DOCUMENTS

| | | | |
|---|---|---|---|
| 791,853 | 6/1905 | Word | 403/408.1 |
| 1,683,418 | 9/1928 | Shaw et al. | 439/877 |
| 1,874,593 | 8/1932 | Olson | 439/883 |
| 2,604,986 | 7/1952 | Berg | 439/877 |
| 4,223,586 | 9/1980 | Miller | 439/801 X |
| 4,832,629 | 5/1989 | Sasaki et al. | 439/883 X |

FOREIGN PATENT DOCUMENTS

| | | |
|---|---|---|
| 2-34768 | 9/1990 | Japan . |
| 202958 | 6/1924 | United Kingdom . |

OTHER PUBLICATIONS

Midland Ross, "E" Strip Terminals Catalogu, p. 23, Lock Nut Tongue.

United Kingdom Search Report.

*Primary Examiner*—Kenneth J. Ramsey

*Attorney, Agent, or Firm*—Sandler, Greenblum & Bernstein

[57] ABSTRACT

A terminal arrangement for connecting a wire to a panel formed with a locking hole, has a terminal connector formed with a mounting hole for bolt passage and a wire connector for tightly receiving a wire. A bent portion is raised integrally from one inside edge of the mounting hole. The bent portion is inserted to the locking hole to position and temporarily hold the terminal arrangement to the locking hole.

8 Claims, 4 Drawing Sheets

TERMINAL ARRANGEMENT

BACKGROUND OF THE INVENTION

1. Field of the Invention

The present invention relates to a terminal arrangement, particularly suitable for a ground terminal for use in automotive wiring harnesses, and more specifically, to a fastening arrangement of a ground terminal connected to a wire end to a body panel using a bolt.

2. Description of the Prior Art

As shown in FIG. 6, a conventional ground terminal 1 typically comprises a wire connector 1*a* crimped to the electrical wire 2, and a terminal connector 1*c* having a center hole 1*b* through which the bolt 3 is passed. The ground terminal 1 is fastened to the body panel 4 by setting the terminal connector 1*c* over the ground terminal locking hole 4*a* provided in the body panel 4, passing the bolt 3 through the hole 1*b* in the ground terminal 1 and then through the ground terminal locking hole 4*a*, and then tightening the bolt 3 to a nut 5 previously fastened to the inside of the body panel 4.

Securing the ground terminal 1 to the body panel 4 can be made even easier if the ground terminal 1 is semi-engaged with the center hole 1*b* of the ground terminal 1 aligned with the ground terminal locking hole 4*a*.

As shown in FIG. 6, a ground terminal 1 is disclosed in Japanese Utility Model Publication No. 2-34768, which terminal 1 has arms 1*d* bent integrally from the outside circumference part of the terminal connector 1*c* part of the ground terminal 1 has been proposed. With this ground terminal 1, the arms 1*d* are inserted to slits 4*b* formed on both sides of the ground terminal locking hole 4*a* in the body panel 4 to position the ground terminal 1.

With this ground terminal 1, however, the slits 4*b* must be provided separately to the ground terminal locking hole 4*a* in the body panel 4 (or other installed-to member) because the arms 1*d* are provided on the outside circumference part of the terminal connector 1*c*.

In addition, this ground terminal 1 is manufactured by stamping the fully opened ground terminal 1 from a metal plate 6 using a press or other too, and because the arms 1*d* extend out to both sides as shown in FIG. 7, there is excessive material waste and material yield is low.

SUMMARY OF THE INVENTION

Therefore, an object of the present invention is to eliminate the need for positioning slits in the body panel, and to improve the yield of the materials used for ground terminal manufacture.

To achieve this object, according to the present invention, a terminal arrangement (ground terminal) for connecting a wire to a receiving member formed with a locking hole comprises a wire connector portion for an electrical connection with the wire; a terminal connector portion integrally formed with the wire connector portion and formed with a mounting hole; and a bent portion raised integrally from an inside edge of the mounting hole, whereby the terminal assembly is temporarily held in position by insertion of the bent portion to the locking hole.

A bent portion may be provided on both sides of the mounting hole for engagement with both side edges of the locking hole.

Bent portions provided at both sides of the mounting hole may be provided at both sides of a single terminal arrangement, or a pair of terminal arrangements each comprising only one bent portion on one side can be used with the bent portion of one terminal arrangement passing through the mounting hole of the other terminal arrangement such that the bent portions project from both sides of the combined single mounting hole.

The terminal arrangement may be connected to a wiring harness that is passed through a protector comprising a screw hole projecting from the protector for securing the protector to the body. In this application, the bent portions of the terminal arrangement are inserted to the protector screw hole, which is also the locking hole, to anchor the terminal arrangement.

By providing the terminal arrangement with a bent portion raised from the inside edge of the mounting hole, the conventionally wasted cut-out from the mounting hole can be used to provide the bent portions when stamping the extended terminal arrangement from a metal plate. Thus, the product yield of the metal plate can be improved.

In addition, because the terminal arrangement can be positioned by simply inserting the bent portions of the terminal arrangement to the locking hole provided in the body panel or protector, it is not necessary to hold the terminal arrangement when tightening with a bolt. Tightening the bolt to anchor the terminal arrangement therefore becomes easier, and productivity improves.

BRIEF DESCRIPTION OF THE DRAWING

The present invention will become more fully understood from the detailed description given below and the accompanying diagrams wherein.

DESCRIPTION OF PREFERRED EMBODIMENTS

The preferred embodiments of the present invention are described below with reference to the accompanying figures.

Figure 1:
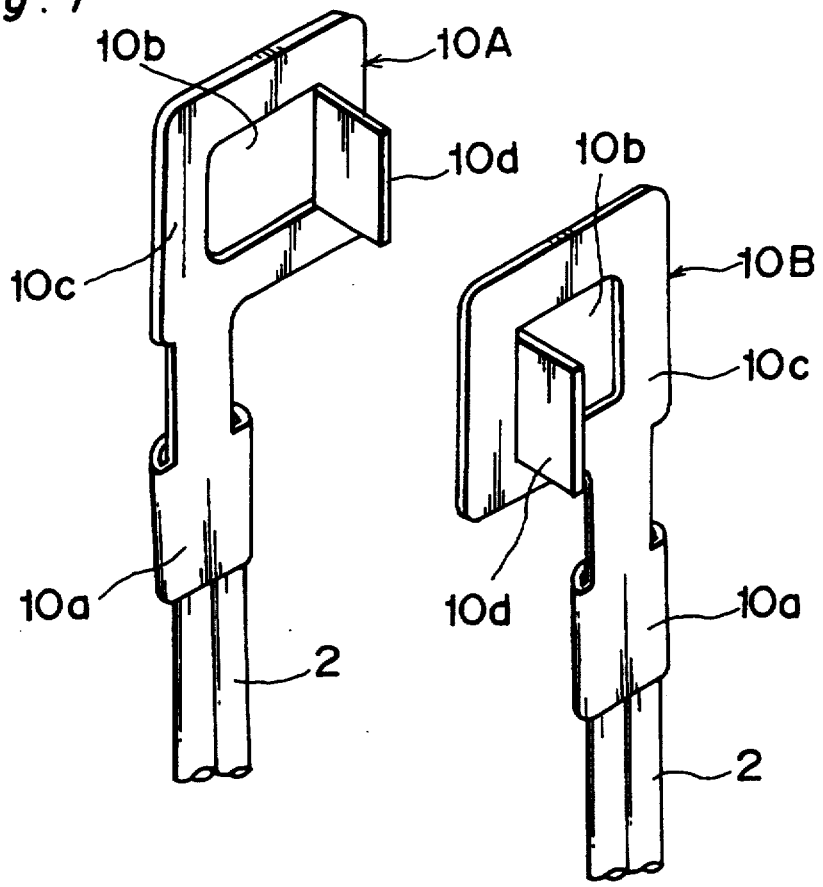
FIG. 1 is a perspective view of two ground terminals used overlapping according to a first embodiment of the present invention.

Referring to FIG. 1, the terminal arrangements 10A and 10B for grounding are placed together when they are attached to a panel. Each of the ground terminals 10A and 10B comprises a wire connector 10*a* crimping the electrical wire 2, and a terminal connector 10*c*. A mounting hole 10*b* through which a bolt 3 is passed is provided in the center of each terminal connector 10*c*.

Note that the wire connectors 10*a* of the two ground terminals 10A and 10B are offset so that the wire connectors 10a are positioned side by side and do not overlap.

A bent portion 10d is formed integrally to each mounting hole 10b, specifically at the inside edge on one side of the mounting hole 10b in the terminal connector 10c of each ground terminal 10A and 10B. Note that the bent portions 10d are positioned to be on opposing sides when the ground terminals 10A and 10B are placed together.

Figure 2:
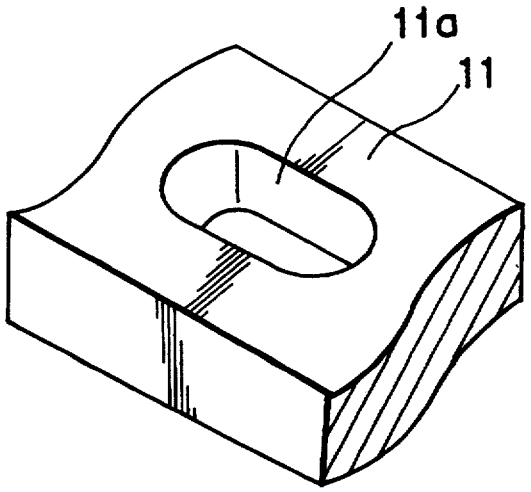
FIG. 2 is a perspective view of the ground terminal locking hole in a panel or other installed-to member.

As shown in FIG. 2, an elongated ground terminal locking hole 11a to which the bent portions 10d of the two overlapping ground terminals 10A and 10B are inserted is provided in the body panel or other installed to member 11.

Using these ground terminals 10A and 10B, one ground terminal 10A overlaps the other ground terminal 10B such that the bent portion 10d of the one (overlapping) ground terminal 10A fits through the mounting hole 10b of the other (overlapped) ground terminal 10B. As a result, a pair of bent portions 10d projects from the same face of the combined mounting hole 10b of the two overlapping ground terminals 10A and 10B.

When the bent portions 10d are inserted from above to the ground terminal locking hole 11a of the panel 11 with the ground terminals 10A and 10B overlapping, the bent portions 10d contact the inside edges of the ground terminal locking hole 11a, and the terminal connectors 10c are held against the outside surface of the panel 11.

By then inserting the bolt 3 from above through the mounting hole 10b and tightening the bolt 3 to a nut 5 that is pre-fastened to the underside of the panel 11 from this position, the ground terminals 10A and 10B are fastened to the panel 11.

It should be noted that the bent portions 10d of the ground terminals 10A and 10B are formed using the cut-out of the mounting hole 10b that is normally wasted in conventional ground terminals manufactured by stamping a metal plate, thus improving the material yield. Assembly is also made easier because the ground terminals 10A and 10B are positioned and partially engaged by inserting the bent portions 10d of the ground terminals 10A and 10B into the ground terminal locking hole 11a.

Figure 3:
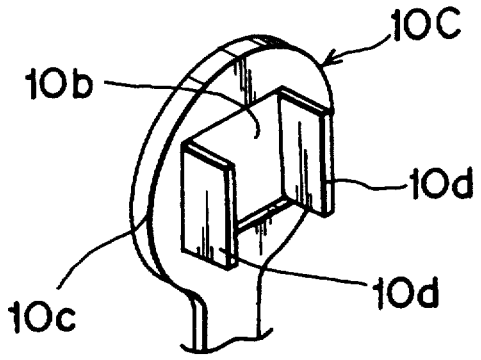
FIG. 3 is a perspective view of a single ground terminal with two bent portions according to a second embodiment of the present invention.
Figure 4A:
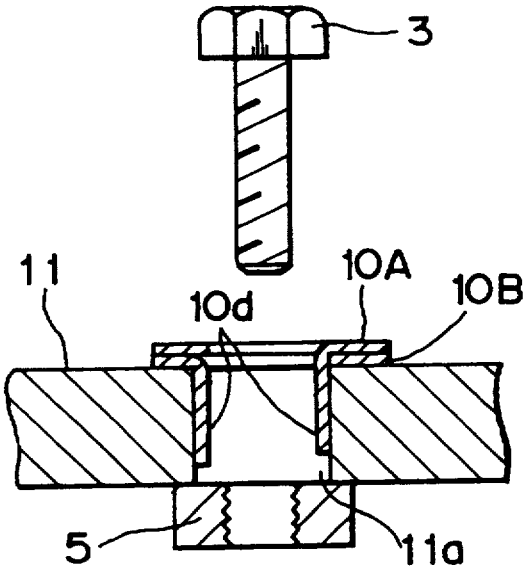
FIGS. 4*a* and 4*b*are cross sectional views showing two overlapping ground terminals of FIG. 1 and single ground terminal of FIG. 3, respectively, assembled to the body panel of FIG. 2.
Figure 4B:
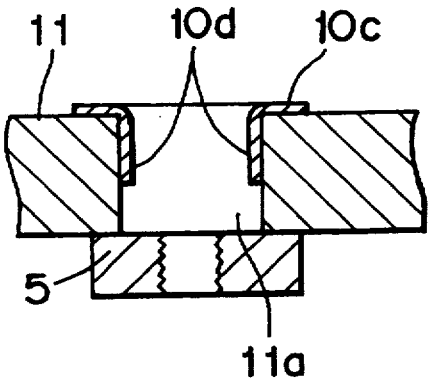

Referring to FIG. 3 a second embodiment of the present invention is shown. According to the second embodiment, two integral bent portions 10d are provided at opposing inside edges of the mounting hole 10b in the terminal connector 10c of a single ground terminal 10C. When the bent portions 10d are inserted from above to the ground terminal locking hole 11a in the panel 11, the ground terminal 10C is positioned by the two bent portions 10d as shown in FIG. 4b.

Figure 5:
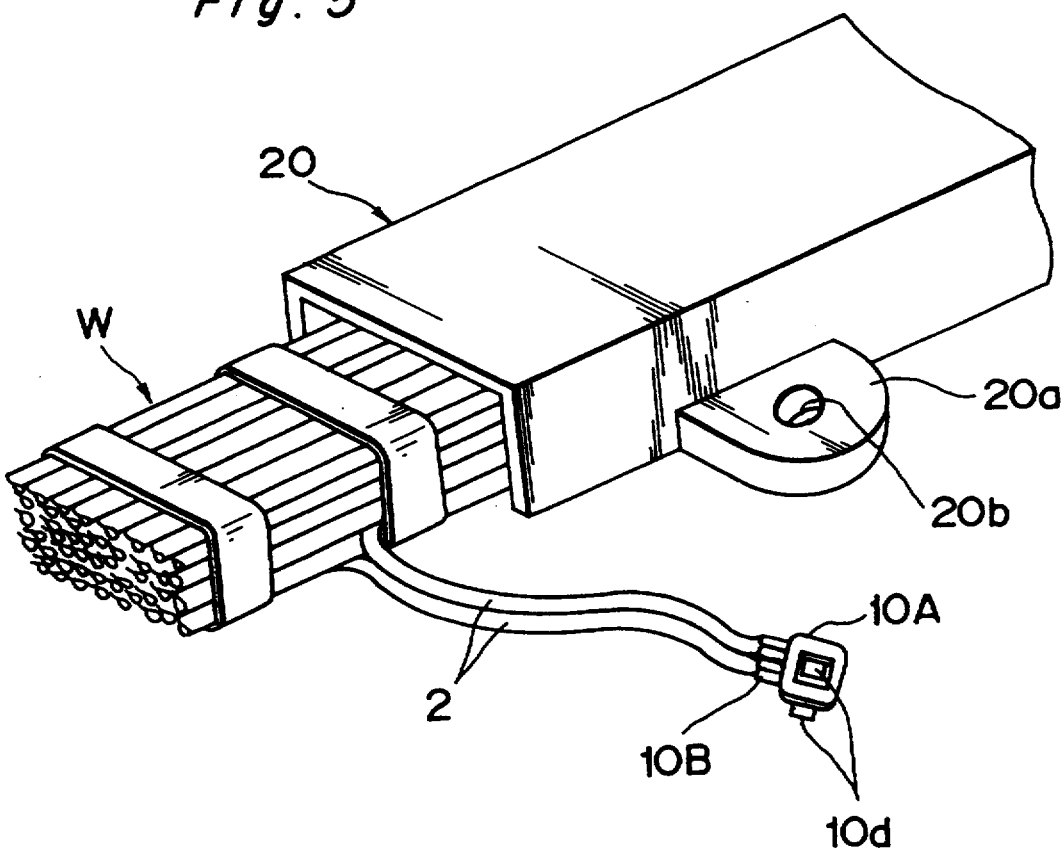
FIG. 5 is a perspective view showing a wiring harness employed with the ground terminal of the present invention.
Figure 6:
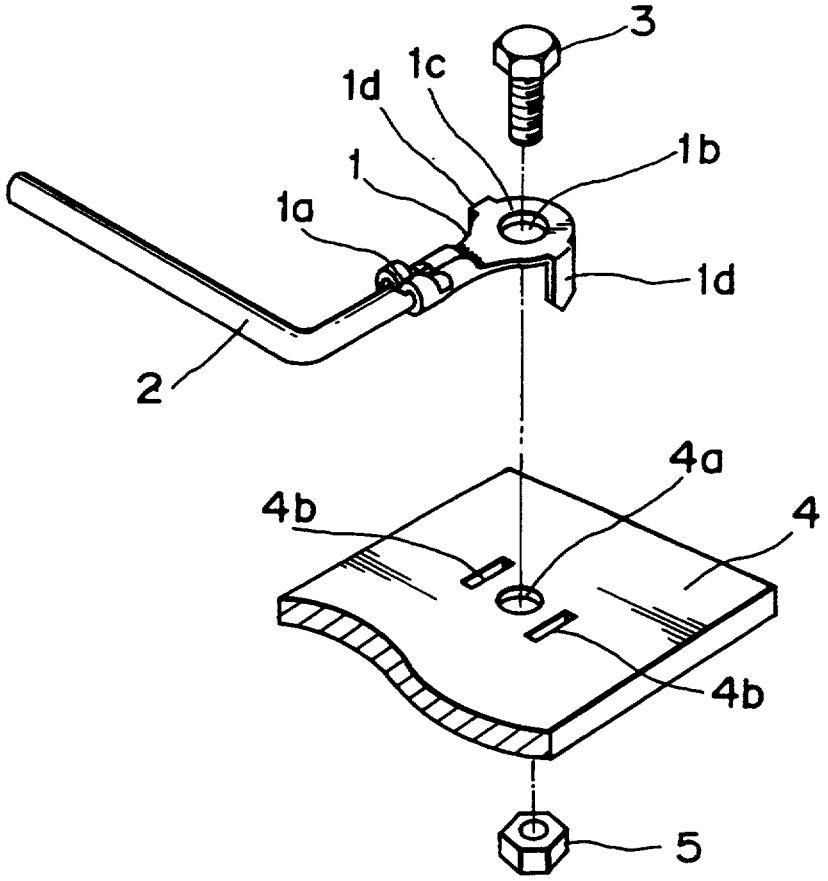
Fig. 6 PRIOR ART
FIG. 6 is a perspective view of a prior art ground terminal.
Figure 7:
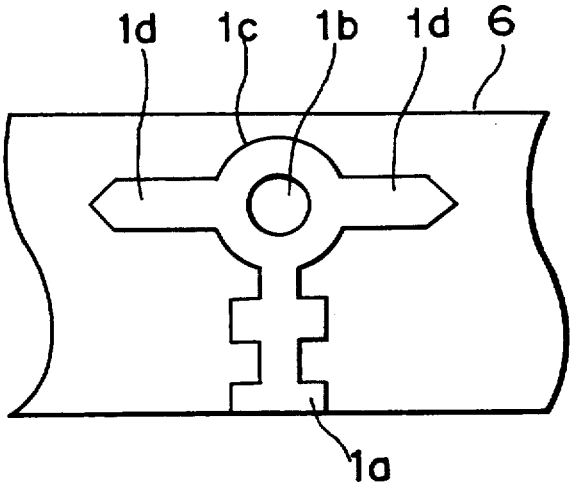
Fig. 7 PRIOR ART
FIG. 7 is a plan view of the prior art ground terminal as stamped from metal plate.

FIG. 5 shows one example of a practically used style of the ground terminals 10A and 10B shown in FIG. 1. The ground terminals 10A and 10B are connected to electrical wires 2 from the wiring harness W passed through the protector 20. In this application, the bent portions 10d of the ground terminals 10A and 10B are inserted to the screw hole 20b of the body mounting member 20a formed integrally to the protector 20, and the screw (bolt; not shown in the figure) is passed through the bent portions 10d and tightened into the screw hole 20b.

It is to be noted that the ground terminal locking hole provided in the panel or protector for inserting and engaging the bent portions of the ground terminals shall not be limited to the oblong hole as shown in FIG. 2, and any type of hole in which the bent portions can be inserted and engaged with the terminal connector engaged against the outside surface of the hole can be used.

As will be known from the above description, a ground terminal according to the present invention comprises a bent portion with the base thereof at the inside edge of the mounting hole to which the bent portion is integral. As a result, material yield is improved because the cut-out of the mounting hole that becomes waste with conventional manufacturing methods is used as the bent portion.

Assembly is also made easier and productivity is therefore improved because the ground terminal can be positioned and partially engaged by simply inserting the bent portions of the ground terminal to the ground terminal locking hole in the panel or other installed-to member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A terminal arrangement for connecting a wire to a receiving member formed with a locking hole, said terminal arrangement comprising:

a wire connector portion for an electrical connection with said wire;

a terminal connector portion integrally formed with said wire connector portion and formed with a mounting hole, said mounting hole having a predetermined dimension;

a bent portion raised integrally from an inside edge of said mounting hole, and having a dimension substantially co-extensive with the dimension of said mounting hole, whereby said terminal arrangement is temporarily held in position by insertion of said bent portion to said locking hole.

2. A terminal arrangement according to claim 1, wherein said bent portion is provided on side of said mounting hole for engagement with one side edge of said locking hole.

3. A terminal arrangement according to claim 2, wherein two terminal arrangements are used together with the bent portion of one terminal arrangement passing through the mounting hole of the other terminal arrangement such that both bent portions project to one side of said terminal assemblies.

4. A terminal arrangement according to claim 1, wherein said bent portion is provided on both sides of said mounting hole for engagement with both side edges of said locking hole.

5. A terminal arrangement for connecting a wire to a receiving member formed with a locking hole, said terminal arrangement comprising two terminals, each terminal comprising:

a wire connector portion for an electrical connection with said wire;

a terminal connector portion integrally formed with said wire connector portion and formed with a mounting hole;

a bent portion raised integrally from an inside edge of said mounting hole, whereby said terminal arrangement is temporarily held in position by insertion of said bent portion to said locking hole;

wherein said bent portion is provided on one side of said mounting hole for engagement with one side edge of said locking hole and the bent portion of one of said terminals passes through the mounting hole of the other terminal, such that both bent portions project to one side of said terminal assembly.

6. A terminal arrangement for connecting a wire to a receiving member formed with a locking hole, said terminal arrangement comprising two terminals, each terminal comprising:

a wire connector portion for an electrical connection with said wire;

a terminal connector portion integrally formed with said wire connector portion and formed with a mounting hole;

a bent portion raised integrally from an inside edge of said mounting hole, whereby said terminal arrangement is temporarily held in position by insertion of said belt portion to said locking hole;

wherein the bent portion of one of said terminals passes through the mounting hole of the other terminal.

7. A terminal arrangement of claim 6, wherein said bent portion is provided on one side of said mounting hole for engagement with one side edge of said locking hole.

8. A terminal arrangement of claim 6 wherein said bent portion is provided on both sides of said mounting hole for engagement with both side edges of said locking hole.

* * * * *

UNITED STATES PATENT AND TRADEMARK OFFICE

CERTIFICATE OF CORRECTION

PATENT NO. : 5,429,512

DATED : July 4, 1995

INVENTOR(S) : Naohito SAWAMURA

It is certified that error appears in the above-indentified patent and that said Letters Patent is hereby corrected as shown below:

At column 2, line 43, change "4bare" to ---4b are---.
At column 3, lines 13 and 14, change "installed to" to ---installed-to---.

Signed and Sealed this

Sixth Day of August, 1996

Bruce Lehman

*Attest:*

BRUCE LEHMAN

*Attesting Officer*

*Commissioner of Patents and Trademarks*